United States Patent [19]

Mieyal

[11] Patent Number: 4,505,083

[45] Date of Patent: Mar. 19, 1985

[54] DELINEATED CEILING GRID IN SUSPENDED CEILING

[75] Inventor: David F. Mieyal, Strongsville, Ohio

[73] Assignee: Donn Incorporated, Westlake, Ohio

[21] Appl. No.: 362,615

[22] Filed: Mar. 29, 1982

[51] Int. Cl.[3] ..... E04B 5/52

[52] U.S. Cl. ..... 52/476; 52/488; 52/484; 52/664

[58] Field of Search ..... 52/144, 484, 488, 666, 52/664, 667, 476, 777

[56] References Cited

U.S. PATENT DOCUMENTS

| | | | |
|---|---|---|---|
| 3,292,332 | 12/1966 | Jahn | 52/484 |
| 3,327,438 | 6/1967 | Cooper | 52/484 |
| 3,398,497 | 8/1968 | Hellmich | 52/666 |
| 3,501,185 | 3/1970 | Brown et al. | 52/664 |
| 3,693,303 | 9/1972 | Downing, Jr. et al. | 52/476 |
| 3,835,614 | 9/1974 | Downing, Jr. | 52/666 |
| 3,962,841 | 6/1976 | Carroll | 52/354 |
| 4,021,986 | 5/1977 | McCall et al. | 52/475 |
| 4,047,336 | 9/1977 | Stahlhut | 52/488 |
| 4,108,563 | 8/1978 | Brown et al. | 403/347 |
| 4,206,578 | 6/1980 | Mieyal | 52/484 |

*Primary Examiner*—John E. Murtagh

*Assistant Examiner*—Kathryn Ford

*Attorney, Agent, or Firm*—Pearne, Gordon, Sessions, McCoy, Granger & Tilberry

[57] ABSTRACT

A ceiling runner is disclosed for use in a ceiling grid system of a suspended ceiling. Each of the main and lateral runners of this ceiling grid system has a similar shape in the flange at the lower end of a generally T-shaped structure. Such flange has first and second flange portions on each side of the web portion, and these flange portions are joined to the web portion by first and second connector portions which are recessed toward the web portion. This establishes a longitudinal recess in the exposed surface of the flange so that a distinctive appearance of the ceiling runner is provided which has definite longitudinal delineation between the ceiling panels. Preferably, the connector portions are shaped to maintain a panel in its proper centered position or to cam such panel to such centered position. The foregoing abstract is merely a resume of one general application, is not a complete discussion of all principles of operation or applications, and is not to be construed as a limitation on the scope of the claimed subject matter.

9 Claims, 5 Drawing Figures

DELINEATED CEILING GRID IN SUSPENDED CEILING

BACKGROUND OF THE INVENTION

Suspension ceiling grid systems typically provide grid members interconnected to provide rectangular or square openings in which panels are positioned and supported. Some of such systems provide generally U-shaped grid members or runners which provide channel-like recesses between panels. An example of such system is described in U.S. Pat. No. 3,835,614. Such recesses cooperate with the panels in such ceiling systems to provide a delineation between panels which interrupts the ceiling surface in a pattern which provides an aesthetically pleasing appearance. However, such runners are relatively wide and provide a wide recess which tends to dominate the appearance of the ceiling. Further, such runners require substantially more material than the typical tee runner grid system.

In most prior art grid systems, the grid members or runners are formed with a cross section of an inverted "T" and provide a lower or exposed flat surface formed by the oppositely extending flanges on which the panels are supported. In such systems, the assembled grid and panels of the ceiling appear as a planar system in which the panels appear to provide a surface interrupted by a pattern of flat, relatively wide bands. Although such systems are widely used, some people find the bands undesirable. Examples of such systems are illustrated in U.S. Pat. Nos. 3,501,185; 3,693,303; and 4,108,563.

Further, in such systems it is necessary to size the panels with sufficient clearance so that they may be easily inserted and removed, and in some instances where the panels are not accurately sized and the panel is not accurately centered, the panel can shift to one side of the grid opening and leave an unsightly crack or opening between a panel edge and the adjacent grid flange.

It is also known in some instances to provide a generally T-shaped grid member with a downwardly open slot shaped to receive T-fasteners which can be positioned in the slot and used to support various equipment or fixtures. Such grid systems are often used in hospitals where patient privacy curtains or other equipment can be mounted on the T-fasteners. An example of such systems is illustrated in U.S. Pat. No. 4,021,986.

SUMMARY OF THE INVENTION

A novel and improved suspended ceiling is disclosed having runners for use in a ceiling grid system. Each of the main and lateral runners of this ceiling grid system has a similar shape in the flange at the lower end of a generally T-shaped structure. Such flanges have opposite, horizontally extending panel support surfaces which are joined to the web by recessed portions or connector portions. This establishes a longitudinal recess in the exposed surface of the flange so that a distinctive appearance of the ceiling runner is provided which has definite longitudinal delineation between the ceiling panels. The panel support flanges are relatively narrow, and therefore do not provide the wide-band appearance of most prior art grid systems. Proper panel centering action is provided by the connector portions, which in some illustrated embodiments provide a camming action tending to move the panels to a centered position. In other illustrated embodiments, the connecting portions provide a steplike structure which engages a properly positioned panel along its edges and maintains such panels properly centered.

Accordingly, an object of the invention is to provide a novel and improved suspended ceiling grid structure with definitely observable delineations.

Another object of the invention is to provide a novel and improved ceiling grid structure which has a tendency toward automatic centering of the ceiling panels.

A further object of the invention is to provide a novel and improved ceiling grid structure with an exposed, longitudinal recess in each grid runner.

Other objects and a fuller understanding of the invention may be had by referring to the following description and claims, taken in conjunction with the accompanying drawings.

DESCRIPTION OF THE PREFERRED EMBODIMENTS

Figure 1:
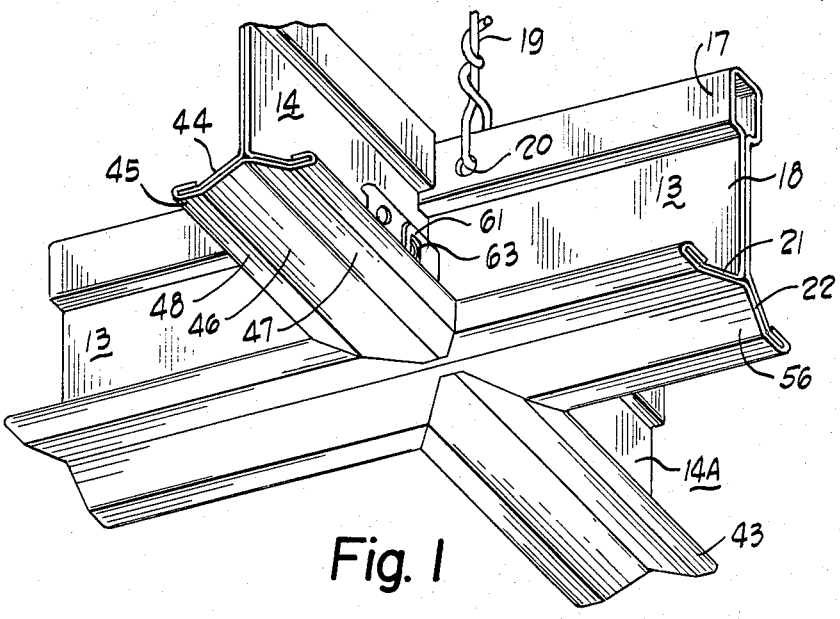
FIG. 1 is a perspective view from below of the ceiling grid system.
Figure 2:
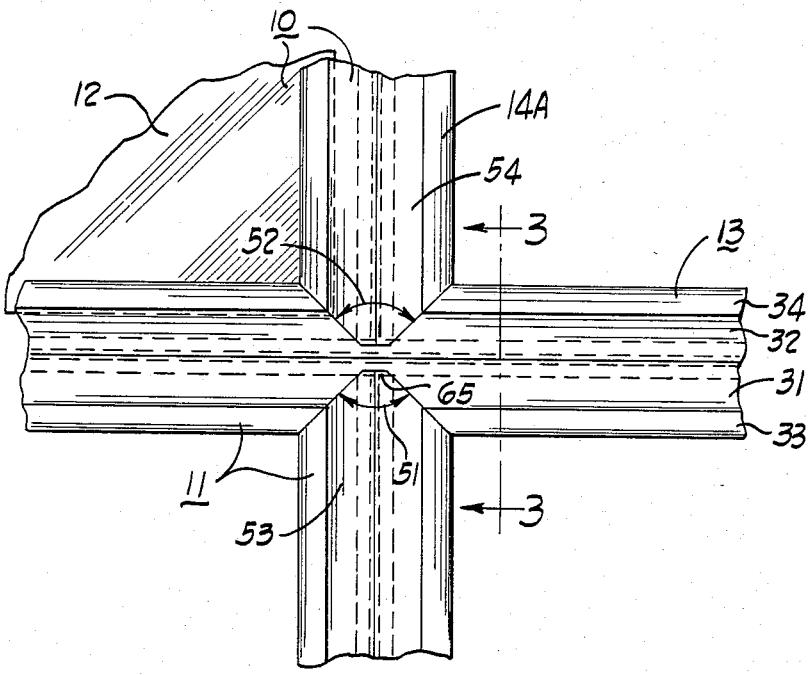
FIG. 2 is a bottom view of the grid system.
Figure 3:
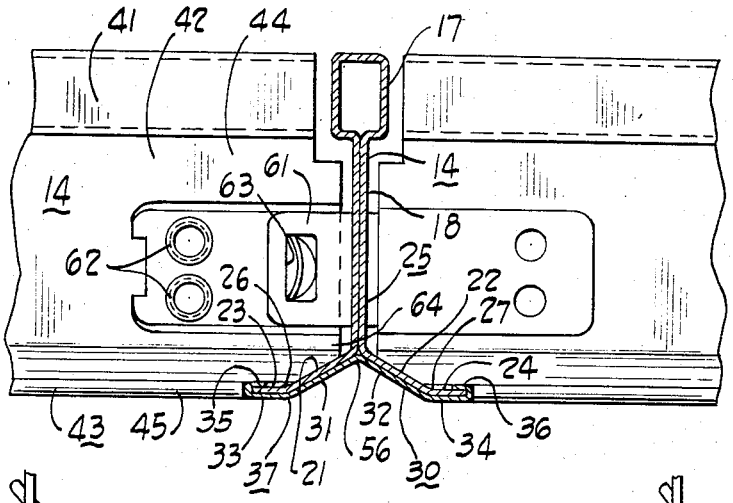
FIG. 3 is an enlarged, sectional view on the line 3—3 of FIG. 2.

FIGS. 1, 2, and 3 illustrate a ceiling grid system 11 which may be used in a suspended ceiling 10, wherein such ceiling includes the grid system 11 plus ceiling panels 12. In general, the ceiling grid system 11 includes first or main runners 13 and second or lateral runners 14. Each of the runners 13 and 14 is generally T-shaped, and an inverted T-shape as installed as a suspended ceiling grid system. In the main runner 13, for example, there is a stiffening bulb 17 which extends longitudinally near the top of a web means or web portion 18, which is generally vertically disposed when the main runner 13 is supported from a structural ceiling support, e.g., by a support wire 19 extending through a selected one of apertures 20 in the main runner 13. At the lower end of the web portion 18, first and second connector portions 21 and 22, respectively, are unitary with the bottom of the web portion 18. First and second flange portions 23 and 24 are unitary at first and second junction lines 26 and 27, respectively, with the outer edges of the first and second connector portions 21 and 22, respectively. In the illustrated embodiment, the aforementioned parts 17, 18, and 21–24 are part of a first metal strip 25 which has been bent, for example, through progressive roller dies, to the cross-sectional shape shown in FIG. 3. A second metal strip 30 is used together with the first metal strip to form the runners 13 and 14. This second metal strip 30 has first and second connector portions 31 and 32 unitarily interconnected and forming a longitudinally extending recess in the bottom surface of the main runners 13 and 14. First and second flange portions 33 and 34 are unitarily attached to the outer edges of the first and second connector portions 31 and 32. In the preferred embodiment, these flange portions 33 and 34 are perpendicular to the web portion 18. First and second crimped edges 35 and 36 are unitarily attached to the outer edges of the flange portions 33 and 34, respectively, and are turned upwardly and over the flange portions 23 and 24 of the first metal strip 25. These edges are then crimped tightly to the outer edges of these flange portions 23 and 24 to secure together the first and second metal strips and to make a composite flange 37 which stiffens the entire structure of the runners 13 and 14.

The stiffening bulb 17 is a bulbous enlargement which may be considered a box beam for withstanding lateral and compression forces at the top of the main runner, whereas, the flange 37 is stressed primarily in tension. This flange 37 is composed of the flange portions 23, 24, 33, and 34, and their interconnection to the web portion 18.

Although the illustrated embodiments of this invention include two strips which cooperate to form the runners, it is also within the scope of this invention to form the runners from a single piece of metal formed as main runs which are normally assembled in long lengths which extend the entire length of a room and are supported by wires. In such systems, cross runs, which may also be formed of a single metal strip, are interconnected between the main runs to form the grid system. Alternatively, the first and second runners 13 and 14 may be identical, and used in a basketweave-configured grid structure.

A mitered joint is provided between the main and lateral runners 13 and 14, as best shown in FIGS. 1 and 2 This mitered joint includes an angled cut 51 in the first connector portions 21 and 31, and also in the preferred embodiment a continuation of that angled cut through the first flange portions 23 and 33. This angled cut 51, therefore, cuts away one side of the composite flange 37 to receive the runner 14. An additional lateral runner 14A is shown in FIGS. 1 and 2 as being aligned with the lateral runner 14, and this lateral runner 14A has another mitered joint with the main runner opposite the lateral runner 14. To effect this mitered joint, there is an angled cut 52 which extends through at least the second connector portions 22 and 32, and in its preferred embodiment also through the second flange portions 24 and 34. There is a mitered end 53 on the lateral runner 14 to mate with the angled cut 51, and there is a mitered end 54 on the lateral runner 14A to mate with the angled cut 52. Preferably, the angled cuts terminate at 65 a short distance back from the centerline of the runner so that some connector portion material extends past the cuts to maintain strength of the runner 13 past the joint. In practice, this structure does not adversely affect the appearance of the miter joint.

As best shown in FIG. 3, the flange portions 33 and 34 are in the same plane, and the first and second connector portions 31 and 32 are bent out of that plane and bent toward the web portion 18. This forms the longitudinal recess 56. The mitered joint at at least the angled cuts 51 and 52 in the connector portions will provide a smooth joint between the main and lateral runners and provide full continuity of the recess 56 in both main and auxiliary runners. It is possible to overlap the flange portions of the main runner and lateral runners, for example, by a square cut, but the angled cut through the first and second connector portions 31 and 32 is preferred to provide the mitered joint for smoothly joining these connector portions.

FIGS. 1 and 3 illustrate one form of end connector 61 secured to the lateral runner 14 by rivets 62. This connector tongue extends through an aperture 63 in the web portion 18 of the main runner 13. This supports the end of the lateral runner 14 in the proper position so that the mitered joint is a smooth junction. Such end connector 61 and aperture 63 are spaced up from the recess in the lower portions of the runner and are not visible in an installed ceiling. Reference may be made to U.S. Pat. No. 4,108,563 for a detailed description of such end connector.

It will be noted that in the main runner 13, the first strip of metal 25 is bent along a longitudinally central line to form the stiffening bulb 17, and then the web portion 18 is formed by two face-to-face and substantially abutting longitudinal portions of that first metal strip 25. The first and second flange portions 33 and 34 are connected to the lower end of this web portion 18 by the first and second connector portions 31 and 32, respectively. The second metal strip 30 is bent so as to form the longitudinal recess 56, so that the first and second connector portions 31 and 32 lie closely adjacent the first and second connector portions 21 and 22 of the first metal strip 25, and also so that the first and second flange portions 33 and 34 lie closely adjacent the first and second flange portions 23 and 24 of the first metal strip 25. This longitudinal recess 56 may be one of many shapes, but it gives a distinctive appearance of longitudinal delineation between the ceiling panels 12, which may be 2'×4' ceiling panels in a typical ceiling installation.

There is provided some means to attach together the first and second metal strips 25 and 30, and in the preferred embodiment, this includes the edges of the second metal strip, which are turned upwardly and crimped over the outer edges of the first metal strip 25. As best shown in FIG. 3, it will be noted that the first and second connector portions 31 and 32 are established at about a 30-degree angle from the horizontal, namely, the plane established by the flange portions 33 and 34.

Figure 4:
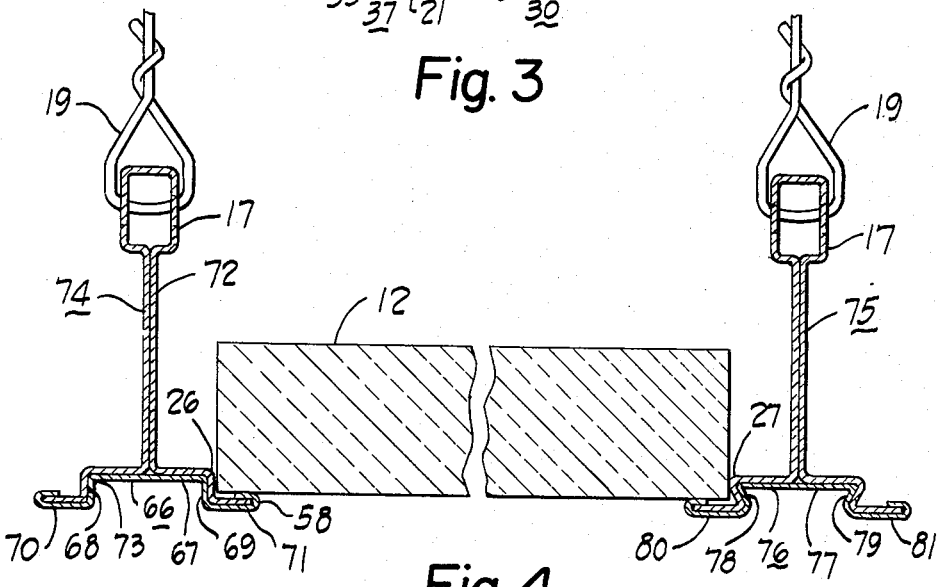
FIG. 4 is an enlarged, sectional view of modifications of the invention.
Figure 5:
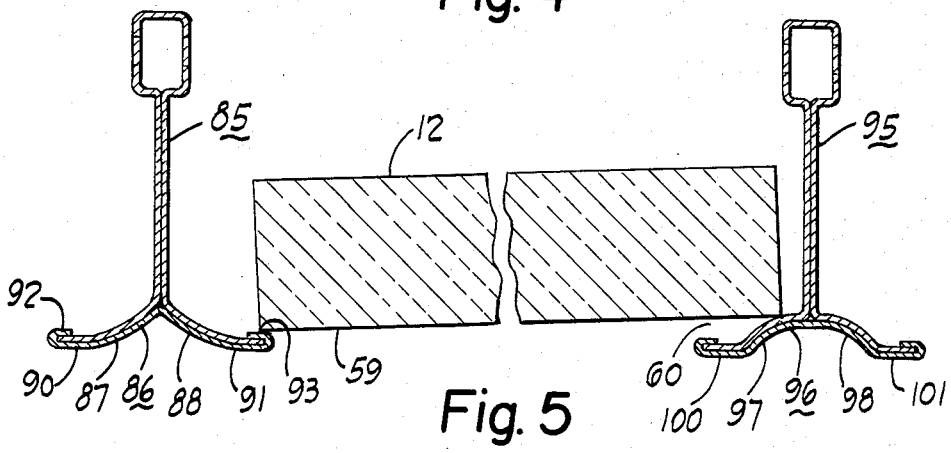
FIG. 5 is an enlarged, sectional view of further modifications.

In FIGS. 4 and 5, different embodiments are illustrated on opposite sides of the panels in order to reduce the number of drawings required to illustrate the present invention. However, in practice, all runners in a given grid system have the same cross section.

The left side of FIG. 4 illustrates a modification of a runner 74, either a main or lateral runner, where a longitudinal recess 66 is provided. This recess is generally rectangular in cross-sectional shape, having an upper wall 67 and sidewalls 68 and 69 which are generally perpendicular to the flange portions 70 and 71, respectively. Again, the preferred embodiment of this modification is one wherein first and second metal strips 72 and 73, respectively, are used to form the composite runner. The sidewalls 68 and 69 and upper wall 67 form the connector portions to connect the flange portions to the web portion.

FIG. 4, at the right side, illustrates a further modified runner 75, which may be either a main runner or a lateral runner which has a longitudinal recess 76. This longitudinal recess is formed by an upper wall 77 and sidewalls 78 and 79 which are reverse-sloping to make a reentrant angle or trapezoidal shape to the longitudinal recess 76. Flange portions 80 and 81 are connected to the outer edges of the sidewalls 78 and 79, which, together with the upper wall 77, constitute the connector portions to connect the flange portions 81 to the web of the runner 75. In other respects, the construction of this runner 75 may be the same as that shown for FIGS. 1–3.

Both embodiments of the runner shown in FIG. 4 provide a steplike structure which engages the edge of an associated panel 12 and properly center such panel once it is installed. In such embodiments, the installer must properly center the panel. If a panel is not properly centered, an edge will rest on the upper wall 67 or 77 and be spaced from the associated flange. This provides the installer with a visual indication that the panel is not properly centered and the installer merely moves the panel to its proper centered position, in which it rests on the flanges along all edges.

The left side of FIG. 5 shows a still further embodiment of the invention in a runner 85, which again may be either a main runner or a lateral runner. This runner 85 has a longitudinal recess 86 which is formed by first and second connector portions 87 and 88, these connector portions being convexly curved as viewed from below. First and second flange portions 90 and 91 are joined to the web of the runner 85 by the connector portions 87 and 88. The structure of the remainder of the runner 85 may be the same as that shown for FIGS. 1–3.

The right side of FIG. 5 shows a still further embodiment of a runner 95, which may be either a main runner or a lateral runner. This runner has a longitudinal recess 96 which is formed by first and second connector portions 97 and 98, which are concave as viewed from below. First and second flange portions 100 and 101 are connected to the web of the runner 95 by the connector portions 97 and 98. In other respects, the construction of the runner 95 may be similar to that shown in FIGS. 1–3.

FIG. 4 shows one of the ceiling panels 12 in place on the flanges (in this case flanges 71 and 80) as examples. The panels are preferably dimensioned so that the width thereof is equal to the distance between opposite junction lines 26 and 27 in the respective grid opening 58. The thickness of the metal strips 25 and 30 is somewhat exaggerated in FIGS. 4 and 5 in order to show the cross-sectional hatching.

The panels 12 must have a dimension less than the distance between opposite stiffening bulbs 17 in a grid opening, in order to be able to easily install and remove such panel. Often the support wire 19 is not pinched in tightly against the spine 17, such as is shown in FIG. 4, and accordingly as a practical matter, the panels should have an even smaller dimension to prevent breaking out a portion of the panels, which may be frangible as they hit the wire 19 during installation.

FIG. 5 shows another feature of the invention of a camming action for a tendency toward automatic centering of each ceiling panel 12. When the ceiling panel is first installed, it may be off-center, so that the flat bottom surface 59 is not resting on the flange, such as flange 100, but, instead, is resting on the connector portion, such as portion 97. In such case, there is a vertical spacing 60 between the flange and the flat bottom surface 59. This readily enables the installer to determine an off-center condition of the panel, as a signal to him to center the panel. A slight tapping by the installer, or other vibration, will move the panel toward centering, and it will remain there despite any further vibration. Any vibration imparted to the ceiling 10 will tend to cammingly move the panel 12 from its nonhorizontal position shown in FIG. 5 to a centered, horizontal position resting on all four flanges of the respective grid opening 58.

Because the connecting portions maintain panels properly centered, relatively narrow flange portions can be provided to support the panels without encountering gaps or the like between the panels and associated grid members even though panel sizes are selected to provide ample clearance for easy installation and removal. Preferably, the inner edges of the flanges are spaced apart by a distance at least as great as the width of the bulb so that panels sized to clear the bulbs in a grid will be properly centered by the connector portions and properly supported by the associated flanges. Further, if contrast is desired, the recesses of the various embodiments may be colored a dark or other color to emphasize the recesses.

Although the preferred embodiments of this invention have been shown and described, it should be understood that various modifications and rearrangements of the parts may be resorted to without departing from the scope of the invention as disclosed and claimed herein.

What is claimed is:

1. A suspension ceiling comprising, in combination:

a rectangular grid structure and a plurality of rectangular ceiling panels, said grid structure including a plurality of spaced-apart substantially parallel first runners and a plurality of spaced-apart substantially parallel second runners extending substantially perpendicular to said first runners, said first and second runners cooperating to form grid openings for receiving said rectangular ceiling panels;

said runners being connected together by joints located at each corner of each rectangular opening, said joints providing a through runner extending through said joint and a pair of opposed runners terminating adjacent to the associated through runner, each opposed runner providing connecting means connecting the end thereof to said through runner, said connecting means being structured to prevent any substantial movement of the ends of said opposed runners toward each other beyond their normal connected position, said runners having an inverted generally T-shaped structure with a stiffening spine longitudinally disposed thereon, web means depending from said spine and first and second outwardly extending flanges connected to the lower portions of said web means by first and second connector portions, respectively, said first and second flanges lying generally in a common plane perpendicular to said web means and said first and second connector portions being displaced out of plane of said flanges in a direction toward said web means to establish a longitudinal recess along each T-shaped structure exposed to view from below the ceiling grid, a junction line between each flange and the respective connector portions, each said ceiling panel having a length and width dimension substantially equal to the dimensions between opposite junction lines within a given rectangular grid opening whereby if a ceiling panel is not properly centered in the grid opening so that the horizontal bottom surface of said ceiling panel rests on the flanges but instead one edge of the panel rests on a connector portion, the vertical spacing between the panel bottom surface and the respective flanges is observable from below the ceiling, said connector portions also operating to maintain a panel in its proper centered position;

said connecting means by preventing longitudinal movement of adjacent ends of said opposed runners at said joints preventing said opposed runners from causing the adjacent flanges of said through runners to be displaced toward each other by any material amount, the flanges and a portion of said connector portions of said through runners providing notches at about 45° at said joints, and the ends of said flanges and at least a portion of said connecting portion at the ends of said opposed runners being shaped to mate with associated notches and provide a miter joint along both said flanges and said longitudinal recess, said notches terminating at an inner end spaced along said connector portions from said flanges whereby a portion of said connector portions extends past said notches to provide stiffness to said through runners through said joints, said portions of said connector portions extending past said notches being sufficiently small so that they do not materially detract from the appearance of said miter joints.

2. A suspended ceiling as set forth in claim 1, wherein said connector portions are disposed at an acute angle to the horizontal to establish a tendency to automatically center the respective ceiling panel.

3. A suspension ceiling as set forth in claim 1, wherein said connector portion provides a step engageable with an associated edge of said panel to maintain it properly positioned in said grid.

4. A suspension ceiling as set forth in claim 1, wherein said panels have lateral dimensions smaller than the spacing between associated parallel web means to provide clearance for installation and removal, the lateral dimensions of the lower surface of said panels being substantially equal to the spacing between associated parallel junction lines.

5. A ceiling grid system as set forth in claim 1, wherein said first and second connector portions are angled to form a V-shape in cross section.

6. A ceiling grid system as set forth in claim 5, wherein said V-shape has an included angle of approximately 120°.

7. A ceiling runner as set forth in claim 1, wherein said longitudinal recess is generally rectangular in cross section.

8. A ceiling runner as set forth in claim 1, wherein said longitudinal recess is generally trapezoidal in cross section.

9. A suspension ceiling as set forth in claim 1, wherein a separate strip of metal is wrapped around the edges of said flanges and extends along and in engagement with the lower surfaces of said flanges and connector portions to provide the exposed surface of said flanges and of said longitudinal recesses.

* * * * *